United States Patent [19]

Asterö et al.

[11] 4,371,155

[45] Feb. 1, 1983

[54] APPARATUS FOR JOGGING A SHEAF OF PAPERS

[75] Inventors: Ulf J. E. Asterö, Tumba; Johan A. F. Dahlberg, Stockholm; Kjell U. Aberg, Södertälje, all of Sweden

[73] Assignee: Asthausbolagen HB Astero & Stockhaus, Sweden

[21] Appl. No.: 187,724

[22] Filed: Sep. 16, 1980

[30] Foreign Application Priority Data

Oct. 25, 1979 [SE] Sweden ..... 7908860

[51] Int. Cl.[3] ..... B42C 1/12; B65H 31/40

[52] U.S. Cl. ..... 270/53; 100/265; 156/556; 156/578; 271/210; 412/37

[58] Field of Search ..... 271/210, 221, 222, 146, 271/214, 30 A, 149, 160; 414/28, 36, 907; 100/265; 11/1 AD, 1 R; 270/53; 412/33, 37; 156/556, 578

[56] References Cited

U.S. PATENT DOCUMENTS

| | | | |
|---|---|---|---|
| 1,236,892 | 8/1917 | Wilson | 271/210 |
| 2,274,713 | 3/1942 | Kushera | 271/210 |
| 2,573,164 | 10/1951 | Scheinker | 271/210 |
| 2,883,191 | 4/1959 | Peugnet | 271/210 |
| 3,146,473 | 9/1964 | Hoff | 412/37 |
| 3,367,652 | 2/1968 | Stobb | 271/210 |

*Primary Examiner*—Bruce H. Stoner, Jr.
*Attorney, Agent, or Firm*—Burns, Doane, Swecker & Mathis

[57] ABSTRACT

An apparatus is provided for jogging a sheaf of papers to even up the edges in the sheaf or bundle, and includes a resiliently carried bundle compartment (1) together with means (20,21) for vibrating the compartment. The compartment comprises two substantially vertically oriented side walls (3,4), at least one end wall (5), substantially vertically oriented, and at right angles to the side walls (3,4), and a bottom (6) at right angles to said end wall (5), the compartment (1) being adapted to carry the bundle (50) with the chief surfaces thereof substantially in the vertical plane. The bottom (6) of the compartment is provided with a material (7) of high friction, such as foamed plastics, on its upper side. The vibration means (20, 21) is adapted to give the compartment a vertical vibration component as well as a horizontal vibration component which latter intersects the side wall plane of the compartment at an oblique angle. The vibratory movement is preferably shaped as a standing pear as seen in a vertical plane normal to the side wall plane. The other side wall (4) is movable towards said one side wall (4) under the influence of the vibration.

10 Claims, 6 Drawing Figures

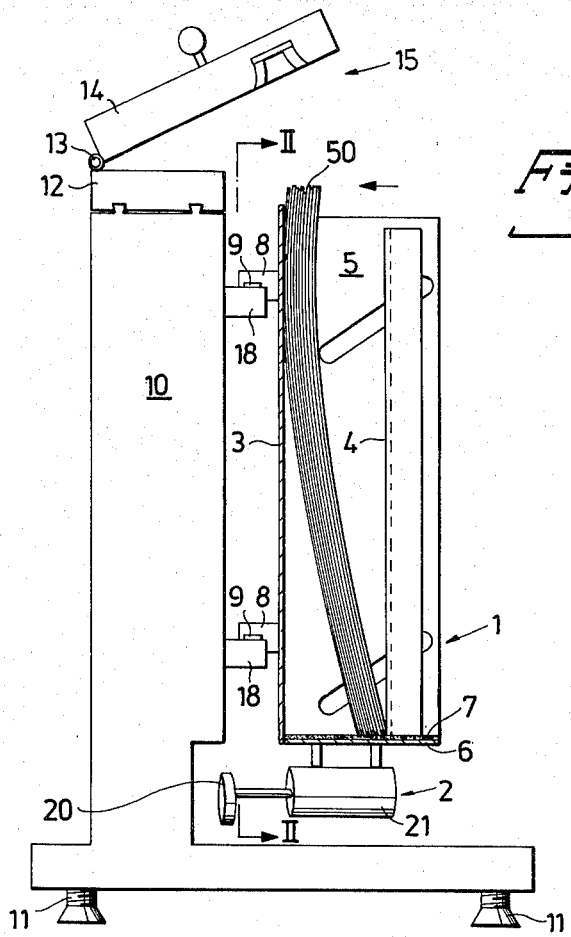
Fig. 1
Fig. 2
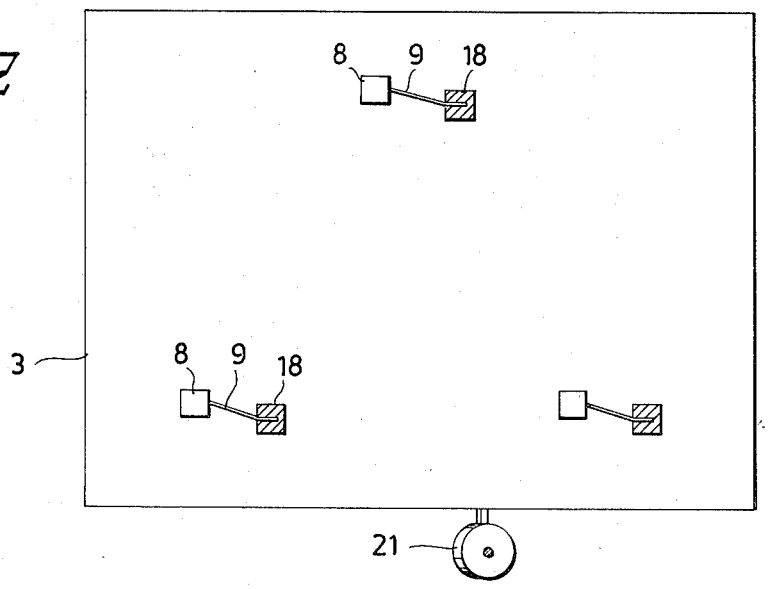

APPARATUS FOR JOGGING A SHEAF OF PAPERS

TECHNICAL FIELD

The invention relates to an apparatus for jogging a sheaf of papers to give it even edges, said apparatus comprising a paper sheaf compartment carried by resilient means and means for vibrating the compartment.

BACKGROUND ART

Apparatus for jogging a sheaf of papers to give said sheaf even edges, so-called joggers, are in general use for preparing stacked sheets of paper (referred to hereinafter as bundles) for binding operations. The known apparatus normally includes a baseplate with a right-angular corner, the plate being oriented with a comparatively small angle to the horizontal plane, so that said corner constitutes the lowest point of the baseplate. Side strips are arranged along the sides of the baseplate and at right angles to its, these strips adjoining said corner. This apparatus is ordinarily provided with a vibrator, the vibratory movement of which is normally in the plane of the baseplate. The bundle to be jogged has the chief surfaces of the sheets of paper more closely to the horizontal plane than to the vertical plane.

When the edges of a bundle have been evened in such an apparatus, the bundle must usually be removed therefrom and transferred to a binding machine for binding.

However, a plurality of problems have been noted in conjunction with the known technique. In the first place, it has been found that the bottommost sheet, or sheets, in a bundle which is to be jogged in such a known apparatus, has a tendency to creep out from between the baseplate and the side strip, thereby making the jogging operation impossible or at least more difficult. In the second place it has often been found that the bundle jogged in the apparatus gets somewhat out of shape in transference from the apparatus to the binding machine.

OBJECT OF THE INVENTION

One object of the invention is therefore to propose a jogging apparatus, the execution of which eliminates or reduces the problem relating to the tendency of one or more sheets to leave the sheaf during the jogging operation, thus making the operation more difficult. A further object is to propose an apparatus such as directly prepares the bundle for a subsequent binding operation of the type in which the bundle is oriented with the main surfaces of the sheets substantially in the vertical plane, whereafter binding agent is applied, preferably a liquid binding agent, against the upper edge of the bundle thus oriented.

A still further object of the invention is to provide a jogging apparatus which automatically clamps the bundle after the jogging operation, as a preparatory step to the binding operation. Yet another object is to propose an apparatus easily allowing optional vibration amplitudes for different bundle weights.

DISCLOSURE OF THE INVENTION

The inventive apparatus for jogging a bundle to form even edges thereon is based on the art involving a bundle compartment carried by yielding means with vibrating means provided to allow vibration of the compartment. The inventive apparatus is accordingly distinguished in that the bundle compartment includes two substantially parallel and vertically oriented side walls, at least one substantially vertically oriented end wall which is at right angles to the side walls, and a bottom at right angles to said end wall, the compartment being adapted for carrying the bundle with the main surfaces of the sheets therein substantially in the vertical plane; in that the bottom of the compartment is provided with a material having high friction, e.g. foam rubber; and in that the vibrating means is adapted to give the compartment a vertical as well as a horizontal vibration component, the latter component intersecing the side wall plane of the compartment at an oblique angle. One side wall is preferably disposed for moving towards the other side wall. This movable wall can be adapted for being driven via the vibration caused by the vibrating means. It is then suitable to have spring means and/or a gravity-activated mechanism adapted for guiding or urging the movable side wall towards the fixed one during the vibratory movement.

The bundle compartment is suitably incorporated as a stationary bundle holder in a a conventional binding machine of the type in which a conventional binding agent is applied to the upper edge of the jogged bundle oriented vertically in the compartment, and kept together by the side walls.

The means for resiliently carrying the bundle compartment are preferably executed as leaf spring elements. Said means are suitably made in a way such as to enable variation of the effective length of the leaf spring elements. With the condition that the vibrating means is arranged in the form of a motor mounted on the compartment, said motor driving an imbalance shaft at a constant speed, the vibration characteristics of the bundle compartment can be adjusted by varying the effective length of the leaf spring elements. The motor axis is oriented with a small angle to the sidewall plane and substantially horizontally. The motor is preferably fixed on the lower surface of the compartment bottom wall.

In a tested embodiment the leaf spring elements have a vertical thickness of about 1 mm, a horizontal width of about 12 mm and an effective length of about 30 mm.

Preferably three similar spring elements are used, one at upper central region of the side wall and two at the lower side regions of the side wall.

As seen in the side wall plane, the compartment performs a generally pivoting vibratory movement. As seen in a vertical plane normal to the side wall plane, the vibratory movement is presumably pearshaped, that is the horizontal vibration amplitude is higher at the bottom edge of the side wall than at the top edge thereof.

In the tested embodiment, the motor rpm was about 3000.

The bottom of the compartment can be horizontal, viewed in the longitudinal direction thereof, the horizontal vibration component ensuring that during the jogging process the bundle is urged towards one end wall, and jogged even in said direction. It is naturally also possible to ensure that the bottom of the compartment slopes downwards in a direction towards said end wall, so that jogging into evenness is favoured by the gravitationally affected movement of the bundle during vibration. The bottom of the compartment can be planar, as viewed in a transverse cross-section, but it is also possible to allow the part of the bottom farthest from the fixed side wall to be deflected upwards. In such a case it would be gained that the angle between the lower portion of the sheets in a bundle placed in the bundle compartment and their supporting point on the bottom of the compartment would be optimally close to a right angle in the most usual operational case.

ADVANTAGES OF THE INVENTION

The previously-mentioned objects are achieved by the invention. The apparatus allows jogging the bundle to edge evenness without the need of subjecting said bundle to the effect of a force normal to the chief surfaces of the bundle. The apparatus will further clamp the bundle when it has been jogged, clamping taking place in a position such that the bundle assumes a favourable position for a binding operation, the latter signifying that a conventional binding agent is applied to the upper edge of the bundle, this agent being initially in liquid form, and during the action of gravity is allowed limited penetration at the binding edge of the bundle.

A particular feature of the inventive apparatus is that the given vibration in combination with the given lining material on the bottom of the bundle compartment will allow the bottom edge of the bundle to move towards and build up at the fixed side wall during the jogging operation, and that a collected evened-up bundle form can be established by allowing the movable side wall to follow the movement of the bundle towards the fixed side wall by means of the vibratory movement finally to allow the bundle to be clamped between side walls when the edges of said bundle have been jogged even.

The invention, which is defined in the appended patent claims, will now be described in detail in the form of an embodiment while referring to the attached drawings.

DRAWINGS

FIG. 1 is a schematic, partially sectioned side view of a machine including the apparatus in accordance with the invention.

FIG. 2 is a section taken along the line II—II in FIG. 1.

EMBODIMENT

Figure 3:
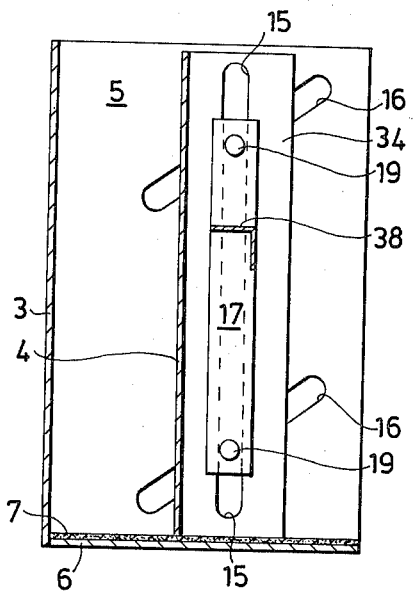
FIG. 3 illustrates a first embodiment of the bundle compartment and how the movable side wall of the compartment is connected thereto.
Figure 5:
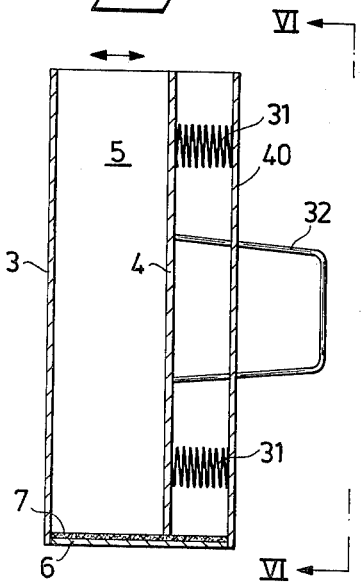
FIG. 5 illustrates a second embodiment of a bundle compartment and how its movable side wall is disposed.
Figure 6:
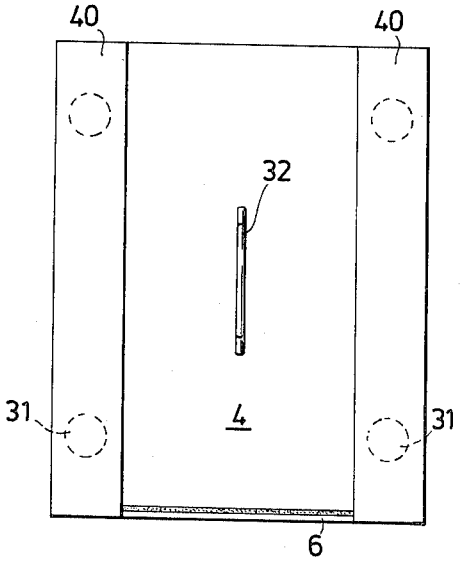
FIG. 6 is a view taken along the line VI—VI in FIG. 5.

A binding machine is illustrated in FIG. 1 and comprises a stand 10 carried on shock-absorbing feet 11. A saddle 12 is arranged displaceable in a direction at right angles to the plane of the figure on the upper part of the stand 10. Via a hinge 13, the saddle 12 carries a tool 14 including a binding means 15. Via springs 9 the stand 10 carries a bundle compartment generally denoted by the numeral 1. One spring 9 is arranged on the upper central portion of side wall 3. Two springs 9 are arranged at the respective lower side portions of side wall 3. The springs 9 have similar characteristics. The spring 9, their location and the low location of the mass center of the compartment with vibration means 2, bring about that the lower edge of the bundle will be moved and evens up during movement. Presumably the horizontal vibration amplitude is higher at the bottom area of the compartment than at the top area thereof. The compartment 1 comprises two parallel side walls 3 and 4, at least one end wall 5 and a bottom 6, the upper surface of which is provided with a material 7 having high friction, such as foam rubber or the like. The compartment 1 is adapted to receive a bundle 50 in a mode such that the chief surfaces of the sheets in said bundle are substantially in the vertical plane. The distance between the side walls 3 and 4 is greater than the thickness of the intended bundles 50, and the compartment is otherwise made so that it can receive the bundle 50 with clearance. The vibration means 2 comprises a motor 21 which is attached to the bottom of the compartment 1 and which is provided with an imbalance weight 20. The motor axis is oriented horizontal and extends with nearly right angle to the side wall plane. The motor 21 is adapted, in coaction with the springs 9, to give the compartment a vibration in a vertical direction as well as in a horizontal direction, which latter intersects the side wall 3 at an oblique angle. Under the action of the vibration, the lower parts of the sheets in the bundle 50 will commonly move towards one of the side walls 3,4 so that said bundle come entirely up against one of the side walls 3 or 4 and a bundle end wall 5. If the vibration is continued, the upper part of the bundle will fall over towards the opposite side wall, whereafter continued vibration causes the lower part of the sheets and thereby the lower part of the bundle to move over towards the other side wall. By allowing the side wall 4 to be made so that it approaches the fixed side wall 3 while the machine is in operation, it is ensured that the bundle, after being evened at the edges, will be stiffened up and clamped as a preparatory step to a binding operation by means of the binding tool 12–15. The leaf springs 9 are suitably made and adapted such that the compartment 1 is subjected to a pear-shaped vibratory movement, the plane of which cuts the side wall 3, the pear shape being upstanding. Accordingly, the springing can be carried out as indicated in FIG. 2, from which it is apparent that three similarly made spring elements are arranged in a triangular pattern and that the vibration motor 21 is adapted at an oblique angle to the fixed side wall 3 of the compartment. FIG. 3 shows how the movable side wall can be connected to the compartment. The end walls of the compartment have a pair of elongate slots 16 inclined downwards towards the fixed side wall 3. The movable side wall 4 has flanges 34 parallel to the end walls 5. The flanges 34 have vertical slots 15. A plate member 17 is adapted on the inside of and along each flange 14. The members 17 are mutually united by means of a cross bar 38. The members 17 are each provided with two pins 19, and each pin extends through a slot 15 and a slot 16. The wall 4 also rests on the friction material 7. Under the action of vibration and the illustrated gravity-controlled guide means 15, 16, 17, 19, 34–38 the side wall 4 will approach the fixed side wall 5 during the course of vibration, to clamp the jogged bundle against the side wall 3 during a final phase, subsequent to which the binding operation can be commenced. The side wall 4 is released by lifting the cross bar 38 and pulling it to the right in FIG. 3. An alternative to the embodiment according to FIG. 3 is illustrated in FIGS. 5 and 6, soft springs 31 being utilized, these springs being fixed between the side pieces 40 of the compartment and the wall 4, the movement of the side wall 4 to the left under the action of the springs 31 being curbed by the friction material 7. The compartment is opened with the aid of a handle 32, which is moved to the right for inserting a new bundle.

Figure 4:
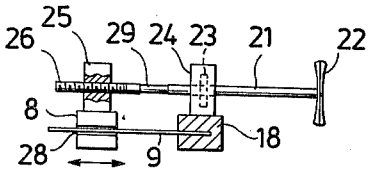
FIG. 4 illustrates a means for varying the effective lengths of the spring means carrying the bundle compartment.

FIG. 4 illustrates how the effective length of the springs 9 can be varied to adjust to the weight of the bundle being dealt with, to provide optimal jogging effect. The member 18 which rigidly attaches the spring 9 to the stand 10 (see FIG. 1) has a member 24 with a bore for a shaft 21, and is adapted together with means 23 for axially restraining said shaft which can be rotated by means of a wheel 22 on the outside of the machine. Via a flexible element 29, the shaft 21 is connected to a screw 26 meshing with a nut 25 which is connected to the member 8 attached to the side wall 3 of the compartment 1.

The member 8 has a slot 28 allowing axial displacement of the spring 9 in the member 8. Thus, rotation of the shaft 21 will result in a variation of the effective spring length of the spring 9.

The principles, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations and changes may be made by those skilled in the art without departing from the spirit of the present invention.

What is claimed is:

1. Apparatus for jogging a sheaf of papers for evening the edges of the sheaf, comprising:

a sheaf compartment including two substantially vertically oriented side walls, at least one end wall substantially vertically oriented and at right angles to the side walls and a bottom wall at right angles to said at least one end wall, wherein said compartment is adapted for carrying the sheaf with its edges lying substantially in the vertical plane, and wherein a high friction material covers the bottom wall of the compartment;

spring means for resiliently supporting said sheaf compartment; and vibration means secured to said compartment for vibrating the compartment, said vibration means giving the compartment a vertical vibration component as well as a horizontal vibration component which latter intersects the side wall plane of the compartment at an oblique angle.

2. The apparatus of claim 1, wherein one side wall is movable and is provided with urging means for urging the one side wall towards the other side wall.

3. The apparatus of claim 2, wherein said one side wall is adapted to rest on the friction material and wherein the vibration movement is arranged to overcome the friction between said one side wall and the friction material, whereby the urging means can move said one side wall.

4. The apparatus of claim 1, wherein the compartment is incorporated as a stationary bundle holder in a binding machine of the type in which binding agent is applied to the upper edge of the vertically oriented, evened-up bundle, which is kept together by the side walls.

5. The apparatus of claim 1, wherein the spring means comprise leaf spring elements and wherein adjustment means are arranged for optional adjustment of the effective spring length of said leaf spring elements.

6. The apparatus of claim 1, wherein the bottom wall of the compartent is horizontal, as seen in a longitudinal cross section.

7. Apparatus for jogging and subsequently binding a sheaf of papers, comprising:

a jogger stand;

a sheaf compartment for holding the sheaf of papers with their edges lying in a substantially vertical plane, including:

at least one end wall, a first side wall, a second side wall movable relative to said first side wall and urging means for urging said second side wall toward said first side wall, and a bottom wall at right angles to said two side walls, and wherein a high friction material covers said bottom wall;

spring means for resiliently supporting said compartment from said jogger stand;

vibration means secured to said compartment for vibrating said compartment, said vibration means giving said compartment a vertical vibration component and a horizontal vibration component, said horizontal vibration component intersecting a side wall plane of said compartment at an oblique angle; and binding agent applying means secured to said stand for applying a binding agent to the sheaf after it has been jogged.

8. The apparatus of claim 2 or 7 wherein said means for urging said side wall are gravity means.

9. The apparatus of claim 2 or 7 wherein said means for urging said side wall are resilient means.

10. The apparatus of claim 7 wherein said second side wall rests on said friction material and wherein said vibration components of said vibration means and said means for urging said second side wall overcome the friction between said second side wall and said friction material whereby said second side wall will move towards said first side wall.

* * * * *